United States Patent [19]

Inaba et al.

[11] Patent Number: 4,724,012

[45] Date of Patent: Feb. 9, 1988

[54] MATERIAL FOR IN-TUBE COMPONENTS AND METHOD OF MANUFACTURING IT

[75] Inventors: Michihiko Inaba; Tetsuo Fujiwara, both of Yokohama; Masaharu Kanto, Hyogo; Yasuhisa Ohtake, Fukaya, all of Japan

[73] Assignee: Kabushiki Kaisha Toshiba, Kawasaki, Japan

[21] Appl. No.: 773,235

[22] Filed: Sep. 6, 1985

[30] Foreign Application Priority Data

Sep. 6, 1984 [JP] Japan ..... 59-186874

[51] Int. Cl.[4] ..... C22C 38/40; C21D 8/10

[52] U.S. Cl. ..... 148/2; 420/43; 420/584; 420/585; 148/442; 148/327; 148/12 B

[58] Field of Search ..... 148/37, 38, 2, 12 B, 148/12.1, 442, 12 C, 327; 420/584, 585, 586, 43

[56] References Cited

U.S. PATENT DOCUMENTS

| | | | |
|---|---|---|---|
| 3,948,685 | 4/1976 | Gray | 420/584 |
| 4,536,226 | 8/1985 | Ohtake et al. | 148/12.1 |

FOREIGN PATENT DOCUMENTS

| | | | |
|---|---|---|---|
| 695795 | 10/1964 | Canada | 148/12 B |
| 2438029 | 2/1975 | Fed. Rep. of Germany | 313/402 |
| 4225446 | 7/1964 | Japan . | |
| 50-58977 | 5/1975 | Japan . | |
| 50-68650 | 9/1975 | Japan . | |
| 56-146829 | 11/1981 | Japan | 148/12 B |
| 57-126915 | 8/1982 | Japan | 148/12 B |
| 59-64749 | 4/1984 | Japan | 420/584 |
| 59-59861 | 4/1984 | Japan | 75/128 R |
| 60-197852 | 10/1985 | Japan | 420/584 |

*Primary Examiner*—Melvyn J. Andrews
*Assistant Examiner*—Deborah Yee
*Attorney, Agent, or Firm*—Oblon, Fisher, Spivak, McClelland & Maier

[57] ABSTRACT

In-tube component material for an electronic tube such as a color cathode ray tube, of low thermal expansion coefficient and grain size 2,000–40,000 grains/mm$^2$, containing Fe as the main constituent and 25–45 wt % Ni, 0.3–10 wt % Cr, and 0–10 wt % Co, and a method of manufacturing it.

12 Claims, 8 Drawing Figures

MATERIAL FOR IN-TUBE COMPONENTS AND METHOD OF MANUFACTURING IT

BACKGROUND OF THE INVENTION

This invention relates to a material for in-tube components and a method of manufacturing it, capable of manufacturing with good formability in-tube components such as shadow masks, frames, inner shields and bimetallic elements used in electronic tubes such as color cathode ray tubes.

So-called in-tube components of colour cathode ray tubes, such as shadow masks, frames, inner shields and bimetallic elements, have previously been made of materials such as rimmed steel or Al killed steel, which has good etching characteristics and formability and a surface on which it is easy to form an oxide film that contributes to lessening reflection of the electron beam. However, as further improvements in colour cathode ray tube quality, i.e. what is known as "easy of viewing" or "high definition" of the displayed image have come to be demanded, to deal with the requirements of various new media, drawbacks have appeared to the use of rimmed steel or Al killed steel as referred to above for shadow masks, frames, inner shields and bimetallic elements.

Specifically, when the colour cathode ray tube is operated, the temperature of the aforementioned members rises to 30°-100° C., causing for example what is called "doming", due to strain in the formed shape of the shadow mask produced by its thermal expansion. This results in misalignment of the relative positions of the shadow mask and the phosphor surface, producing what is known as "purity drift" (PD) of the colours. Particularly in the case of high-quality colour cathode ray tubes, the apertures, and the aperture pitch, of the aforementioned shadow mask are very small, so that the proportion of relative misalignment becomes large, preventing the use of in-tube components made of the aforementioned rimmed steel or Al killed steel. The above problem is particularly marked in the case of colour cathode ray tubes of high curvature with reduced image distortion and reflection of external light.

Previously, therefore, Ni-Fe alloys of small thermal expansion coefficient, such as invar (36Ni-Fe) or superinvar (32Ni-5Co-Fe) were used as the material for forming in-tube components of this type, for example as proposed in U.S. Pat. No. 4420366 (Oka et al.), Japanese Publication No. Sho. 42-25446. Japanese Patent Laid-open No. Sho 50-58977, or Japanese Patent Laid-open No. Sho. 50-68650.

However, Ni-Fe alloys of this type have poor thermal conductivity. Not only does this make them liable to accumulate heat, but also makes them liable to what is known as "spring-back" (depressions towards the electron gun, from the normal spherical surface of the shadow mask). This also gives problems, in etching characteristics and formability such as irregular aperture diameter being obtained when the apertures of the shadow masks are formed by etching.

In more detail, this spring-back exhibits the correlation shown in FIG. 1 with for example the 0.2% yield point of the material. Thus, the lower the 0.2% yield point, the smaller the amount of spring-back and the better the formability.

Previously therefore, to lower the 02.2% yield point of the material, trials were made of subjecting it to vacuum annealing at over 1000° C., or of forming working of the intube component in the temperature range 100°-200° C. Various methods of improving the etching characteristics were also tried. However, the situation is that none of these methods resulted in etching characteristics of formability being attained which were as good as those of the rimmed steel or Al killed steel referred to above. This therefore imposed a limit on the extent to which the quality of colour cathode ray tubes could be improved.

SUMMARY OF THE INVENTION

The object of this invention is to propose a material for use in in-tube components whose thermal expansion coefficient is lower than that of rimmed steel or Al killed steel and which has good etching characteristics and formability, close to those possessed by the aforementioned steels, and a method of manufacturing this material.

This invention consists in a material for in-tube components whose main constituent is an Fe-Ni alloy, of which the main constituent is Fe and containing 25–45 wt % Ni, 0.3–10 wt % Cr, 0–10 wt % Co, and unavoidable impurities.

Another aspect of this invention consists in using an alloy of grain size set at 2,000–40,000 grains/mm$^2$ (i.e. grain size 8–12 as defined in Japanese Industrial Standard JIS-G0551), and formed to be of at least 80% austenitic structure as the material for forming in-tube components such as the shadow mask, inner shield, frame, and bimetallic element in a colour cathode ray tube.

Such an in-tube component material may be manufactured by melting an alloy containing 25–45 wt % Ni, 0.3–10 wt % Cr, 0–10 wt % Co, the remainder Fe and unavoidable impurities, subjecting it to rolling and annealing, then carrying out its final cold rolling with a draft of at least 40%, preferably at least 70%, then performing annealing treatment in a temperature range 500°-1200° C., preferably 900°-1100° C., then performing controlled rolling with a draft of less than 30%, preferably less than 20%, and, if necessary, carrying out strain-relief annealing to obtain in-tube component material of grain size 2,000–40,000 grains/mm$^2$.

The reason why the Ni content is made 25–45 wt % is to make the thermal expansion coefficient less than $90\times10^{-7}$/°C. If the added amount of Ni is outside this range, an intube component material of low thermal expansion coefficient such as is the object of this invention is not obtained. This means that a well-defined image with low PD is not obtained. On the other hand, if the added amount of Ni exceeds 45 wt %, the 0.2% yield point, which is the criterion of formability, is increased, and the formability is very adversely affected. In the case of a shadow mask for example, this leads to spring-back, making it hard to produce a well-defined image. Resistance to oxidation is also increased, making it extremely difficult to subject the surface of the component to the usual blackening treatment.

Also as regards etching characteristics, if the Ni content is made large, fine etching becomes difficult, with problems such as loss of etching speed due to so-called "rough pits" being formed in the inside walls of the etching holes and a large amount of Ni being dissolved into the etching solution.

Co has the effect of decreaseing thermal expansion coefficient and improving etching characteristics. The lower limit of the Co content if it is to have any effect in lowering the thermal expansion coefficient is 0.2 wt %. It is, however, possible to make the Co content zero. the reason for the choice of the upper limit of 10 wt % is that the 0.2% yield point increases little by little with increased Co addition, and the thermal expansion coefficient also increases. The added amount of Co is therefore preferable 3–6 wt %.

In contrast, Cr increases the thermal expansion coefficient of Fe-Ni alloys, but, on the other hand, it makes a large contribution to improving formability, by reducing the aforementioned 0.2% yield point. That is, the aforementioned Cr plays an important role in the annealing step after the flat mask with multiple holes has been obtained by etching in-tube component material of grain size 2,000–40,000 grains/mm$^2$.

In more detail, in general, if Cr is added to a 36Ni-Fe alloy or 32Ni-5Co-Fe alloy, and it is not annealed above the recrystallization temperature, the grain size is very small, so this tends to cause an increase in the 0.2% yield point at room temperature, making it difficult to maintain the curvature of a shadow mask for example. For this reason, the intention of adding the aforementioned Cr is only to increase the strength of the material. However, when specific heat treatments are performed on a 36Ni-Fe alloy or 32Ni-5Co-Fe alloy to which Cr has been added in accordance with this invention, the amount of decrease of the 0.2% yield point is very much greater than in a 36Ni-Fe alloy or 32Ni-5Co-Fe alloy to which Cr has not been added. That is, the Cr contained in the material has an important effect in considerably decreasing the 0.2% yield point of the material in the annealing stage. However, if the amount of Cr added is less than 0.3 wt %, even if the annealing temperature is made as high as 1200° C., as with 32Ni-5Co-Fe alloy containing no Cr, its 0.2% yield point cannot be reduced below 24 kg/mm$^2$ (20 kg/mm$^2$ in the case of 36Ni-Fe alloy). And if the added amount of Cr exceeds 10 wt %, the thermal expansion coefficient becomes $90\times10^{-7}$/°C. or more, causing purity drift. Such an alloy would therefore be unsuitable for use in high precision colour cathode ray tubes. Also if the added amount of Cr exceeds 10 wt %, a protective film of $Cr_2O_3$ tends to be formed on the surface of the alloy. This is inconvenient in blackening treatment, since it lowers the rate of blackening. Taking into account lowered expansion, etching characteristics, and low chroming in waste liquid, the amount of Cr should preferably be 1–4 wt %.

The following Table gives the values fo the 0.2% yield point obtained when materials according to this invention are annealed.

shapes that can be used. In this connection, the material of this invention has a yield point of 16 kg/mm$^2$, and its spring-back value is 5 micron or less. Good molding quality can therefore be maintained. Another element which has the same effect as Cr when added is Mn. Some of the aforementioned Cr can therefore be replaced by addition of Mn.

In FIG. 2, the characteristic A1 shows the variation of the 0.2% yield points with annealing temperature of a material according to this invention consisting of a 36Ni-Fe alloy to which 6 wt % of Cr has been added. The characteristic A2 shows the variation of the 0.2% yield point with annealing temperature of a material according to this invention consisting of a 36Ni-Fe alloy to which 3 wt % of Cr has been added. The characteristic B shows for purposes of comparison the variation of the 0.2% yield point with annealing temperature of a material consisting of a 36Ni-Fe alloy to which no Cr has been added. As shown in this Figure, at room temperature the 0.2% yield point of the in-tube component material according to this invention is higher, but on annealing 500° C. or more a much lower 0.2% yield point is obtained than with the prior art material. For example, the 0.2% yield point of in-tube component material according to this invention when vacuum-annealed at 1000° C.–1200° C. is 12 kg/mm$^2$, but the 0.2% yield point of the prior art alloy, without Cr addition, is as large as about 22 kg/mm$^2$. It can therefore be seen, from this face also, that the aforementioned Cr addition contributes greatly to lowering of the 0.2% yield point on annealing. Mn also has the same effect as Cr. Some of the Cr can therefore be placed by Mn.

Taking the amount of Cr addition as the parameter, FIG. 3 shows the variation characteristic C of the 0.2% yield point on annealing a flat mask formed using the in-tube component material of this invention at 900° C. in hydrogen, and the variation characteristic D of its thermal expansion coefficient. From this Figure also, it can be seen that, if the Cr content is made 0.3–10 wt %, the 0.2% yield point can be kept below 20 kg/mm$^2$ or less by annealing.

It should be noted that prior art examples of addition of Cr to 36Ni-Fe alloy with the object of increasing the strength of the in-tube component material include Japanese Patent Laid-open No. Sho. 59-59861. However, no measures at all were taken to obtain a low yield point; the material was simply increased in strength and a reduction of the 0.2% yield point was not sought. Additionally, as will be described hereinbelow, the grain size and texture were not fixed, and in fact no measures at all were taken to improve the etching char-

| | Chemical constituents (wt %) | | | 0.2% yield point after annealing treatment (kg/mm$^2$) | | | | | |
|---|---|---|---|---|---|---|---|---|---|
| | | | | Thermal expansion coefficient ($\times 10^{-7}$/°C.) | | | | | |
| | Ni | Cr | Co | 30–100° C. | before treatment | 680° C. | 780° C. | 900° C. | 1150° C. |
| Product of this invention | 32 | 2 | 5 | 21.8 | 70.9 | 29.7 | 27.2 | 24.4 | 21.7 |
| | 32 | 4 | 5 | 35.0 | 69.8 | 26.0 | 22.0 | 19.1 | 16.0 |
| | 30 | 2 | 5 | 41.4 | 72.2 | 28.9 | 26.0 | 23.7 | 20.4 |
| comparison product | 32 | 0 | 5 | 9.0 | 73.1 | 32.4 | 30.3 | 28.2 | 26.0 |

When this is compared with the data shown in FIG. 1, in the case of the material of the comparative example, on annealing at 1150° C., a spring-back value of more than 100 micron is found. This therefore imposes limitations on warm pressing or on the shadow mask acteristics. This makes them completely different from the in-tube component material of this invention.

Additionally, for in-tube component material of this type, it is vital to have excellent etching characteristics. This leads to the requirements that there should be few inclusions in the material itself, i.e. high cleanness, uniform grain size and sheet thickness and uniform distribution of the constituents throughout the material. Of these requirements, uniformity of sheet thickness and uniformity of distribution of the constituents can be achieved by advances in rolling techniques, while inclusions can be eliminated by reducing the amount of unavoidable impurities to an absolute minimum.

The problem in obtaining in-tube component material of good etching characteristics therefore lies in obtaining uniformity of grain size and of metallic structure.

Thus, according to this invention, an alloy containing 25–45 wt % Ni, 0.3–10 wt % Cr, 0–10 wt % Co, the remainder Fe and unavoidable impurities, is melted, subjected to rolling and annealing, then the final cold rolling performed with a draft of at least 40%, preferably at least 70%, then subjected to annealing treatment in a temperature range of 500°–1200° C., preferably 900°–1100° C., then to controlled rolling of draft not more than 30%, preferably not more than 20%, and if necessary to strain-relief annealing to obtain a material of grain size 8–12, i.e. 2,000–40,000 grains/mm$^2$, as specified in JIS-G0551. If the grain size is less than 8 (2,000 grains/mm$^2$), the grains become coarse (of large diameter), and portions 23*a* as shown in FIG. 7 for example are produced, in which holes are not formed by the etching process. On the other hand, if the grain size exceeds 12 (40,000 grains/mm$^2$), due to the excessive fitness of the grains, what are known as "rough pits" are produced, as shown by the cross-section of an etched hole shown in FIG. 8, with notching of the inside walls of the holes 25 formed by the etching process. For this reason, for practical use the grain size must be set to 8–12 (2,000–40,000 grains/mm2), so as to make it possible to form uniform holes, as shown in FIG. 5. Preferably, the aforesaid grain size is set to at least 9–11.

Incidentally, if the aforementioned cold rolling is performed with a draft of less than 40%, it beocmes difficult to get the metallic structure even, and sometimes grain size of 2,000–40,000 grains/mm$^2$ will not be obtained. And if the aforementioned annealing is performed below 500° C., the grain size cannot be controlled. On the other hand, if annealing is performed at more than 1200° C., the diameter of the grains may become too large. That is, to assure good etching characteristics, the temperature range of the aforementioned annealing should be set as specified above. The in-tube component material must therefore be manufactured under the aforementioned conditions.

It structures such as ferrite, martensite, or austenite are present in the metal that forms the in-tube component material, there is a risk of incomplete hole formation due to the different rates at which etching proceeds in these structures. In general, therefore, it is desirable that the alloy should be of only a single type of metallic structure.

However, since treatment to achieve such a single type of metallic structure is difficult to carry out, it is in practice sufficient if the aforementioned austenitic structure represents at least 80% of the total. As a specific example, by making the grain size of the in-tube component material 2,000–40,000 grains/mm$^2$ by the method of manufacture described above, and performing controlled rolling to produce an at least 80% austenitic structure, the excellent shape characteristics shown in FIG. 5 can be effectively obtained by etching treatment to give well-defined holes. Regarding this controlled rolling, it should be noted that if the draft is made larger than 30% the metal texture may be destroyed, which is undesirable.

This invention is therefore very effective in providing a material for the manufacture of shadow mask etc., because, according to this invention, by adding Cr to a prescribed Ni-Fe alloy, its 0.2% yield point is reduced and its formability is improvided, and by controlling the grain size and metallic structure the etching characteristics are improved. Moreover, vacuum annealing at high temperature, such as was required with the prior art 32Ni-5Co-Fe alloy, becomes unnecessary and the time required for processes such as warm pressing is eliminated. And by annealing 1200° C. or less, sufficient forming working can be achieved and the etching treatment time can be shortened, enabling uniformly etched holes to be produced.

The thermal expansion coefficient can also be made less than that of the prior art Al killed steel or rimmed steel, and is in fact less than $90\times10^{-7}$/°C. This has the effect that colour cathode ray tubes with little purity drift can easily be realized.

DETAILED DESCRIPTION OF THE PREFERRED EMBODIMENTS

[Embodiment 1]

Figure 1:
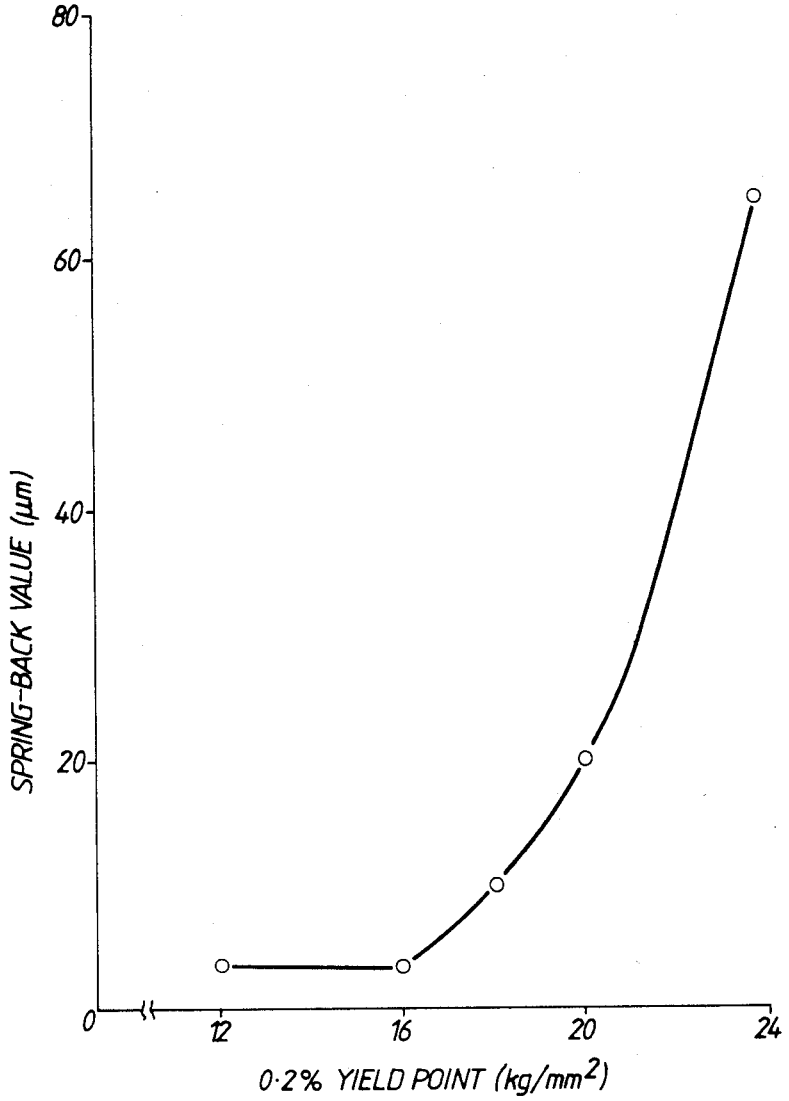
FIG. 1 is a graph showing the relationship between the 0.2% yield point and spring-back value of a shadow mask.
Figure 2:
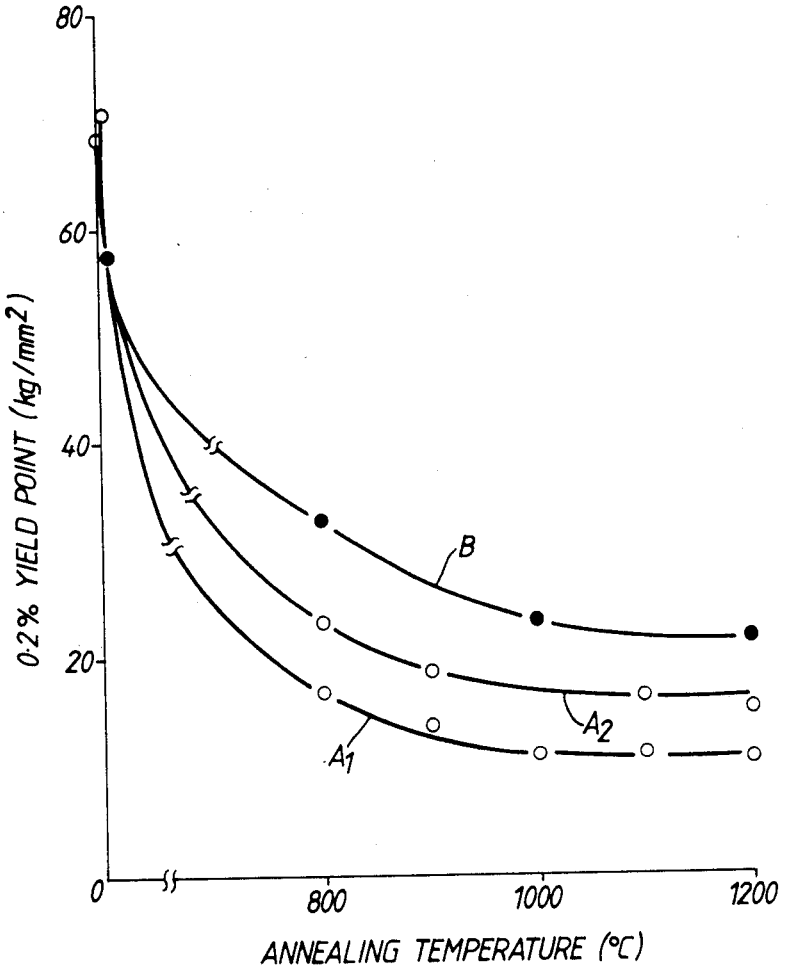
FIG. 2 is a graph given in explanation of this invention, showing the relationship between the 0.2% yield point and annealing temperature.
Figure 3:
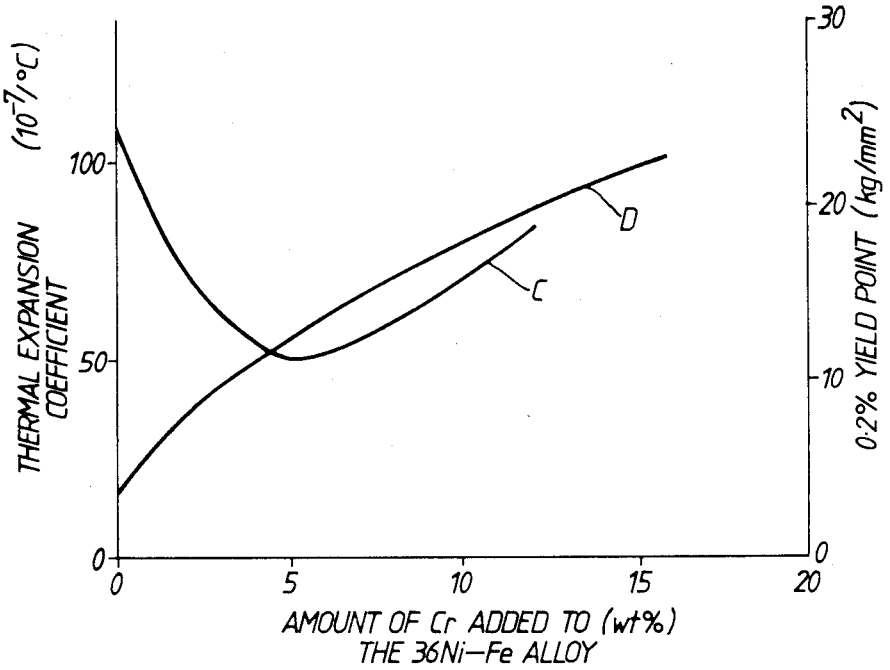
FIG. 3 is a graph given in explanation of this invention, showing the relationship between the amount of Cr added to the 36Ni-Fe alloy and the thermal expansion coefficient.
Figure 4:
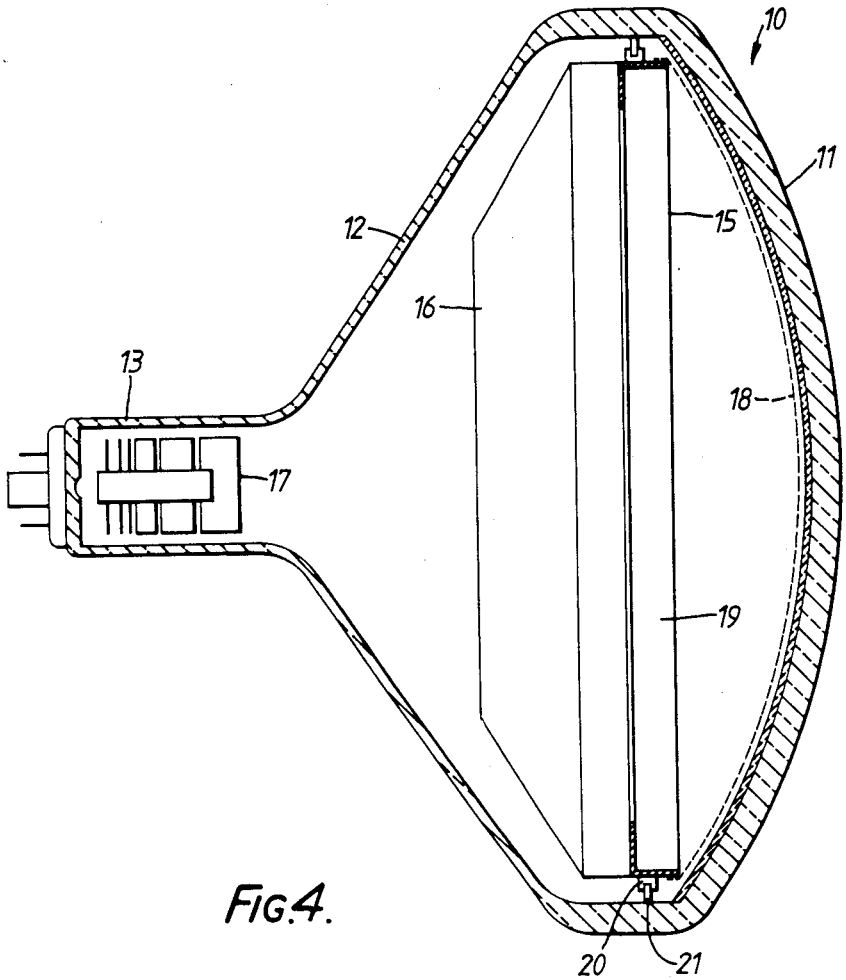
FIG. 4 is a cross-sectional view of a colour cathode ray tube employing a shadow mask according to an embodiment of this invention.

FIG. 4 shows an embodiment wherein the invention is applied to a colour cathode ray tube. A phosphor screen 14, shadow mask assembly 15, inner shield 16 and electron gun 17 are arranged within a glass enclosure 10 formed with a panel 11, funnel 12 and neck 13. The shadow mask assembly 15 comprises a shadow mask 18 that is formed into a curved surface, and a mask frame 19 that supports the periphery of this mask 18. This is fixed, by means of spring support 20 welded to the frame 19, to a stud pin 21 anchored in the inner wall of the panel. The shadow mask assembly 15, inner shield 16, electron gun 17, spring support 20 and stud pin 21 etc. constitute the in-tube components of the colour cathode ray tube. In this embodiment, the invention was applied to the inner shield 16 and shadow mask 18, which are formed of the material and by the manufacturing method detailed below.

First of all, an ingot of alloy containing 32% Ni, 5% Co and Fe as the main constituent, with 4 wt % Cr, and 0.005 wt % C, 0.01 wt % Si, and 0.01 wt % of each of P and S respectively was prepared by vacuum melting. This ingot was then subjected to repeated annealing, washed with acid, and the primary and secondary cold rolling steps performed. A draft of 80% was used in this process.

After the above rolling treatment, this material was annealed at $10^{-4}$ torr, 800° C. in a box-type annealing furnace, then subjected to controlled rolling with a draft of 10%. By this controlled rolling, an in-tube component material having an austenitic structure and of grain size 10 (8,200 grains/mm$^2$ on average) as defined in JIS-G0551 was obtained.

A shadow mask was produced as follows using the in-tube component material manufactured as above.

First of all, both faces of the material were coated with a photoresist, which was dried. A film formed with a standard pattern in the shape of slots or round dots was then stuck tightly onto both faces, and the photoresist exposed and developed. The unexposed portions of photoresist were removed by dissolving in this development process. After this, the remaining photoresist was hardened by burning then etched with ferric chloride solution. The remaining resist was then removed with hot alkali to obtain a flat mask, to be used to form the shadow mask.

This flat mask was treated for strain-relief and improvement of working properties by placing it in a box-type vaccum heating furnace, where it was annealed in an atmosphere of $10^{-4}$ torr, 1000° C. Sheet strain was then removed by passing the annealed flat mask through a leveller, simultaneously removing stretcher strain in the forming step. This vacuum annealing was performed with the object of decreasing the amount of dissolved C in the flat mask and reducing the 0.2% yield point by increasing the grain diameter, in order to facilitate subsequent press forming.

Figure 5:
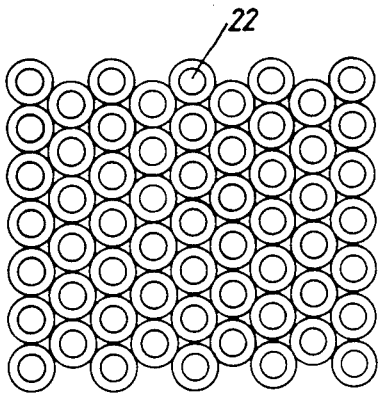
FIG. 5 is a plan view showing part of the hole pattern of the shadow mask of FIG. 4.
Figure 6:
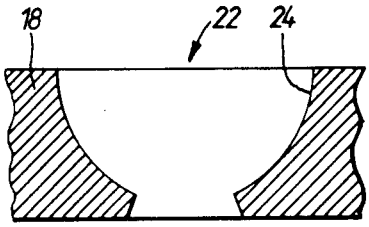
FIG. 6 is a cross-section of part of the shadow mask of FIG. 4, to a larger scale.
Figure 7:
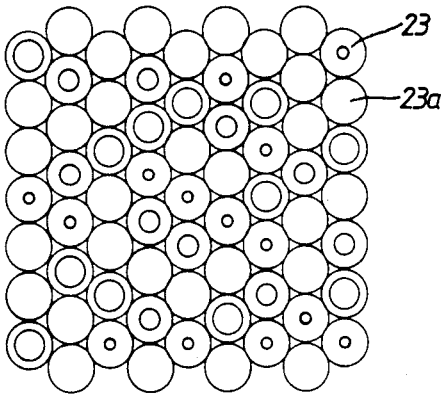
FIG. 7 is a plan view showing part of the hole pattern of a shadow mask with incompletely formed holes, for comparison with FIG. 5.

Next the aforementioned flat mask was press formed, to obtain a shadow mask having the prescribed curvature. In this process. It was confirmed that the material had a low 0.2% yield point with excellent formability, so that spring-back did not occur. It was also confirmed that the material charcteristics were uniform in the width direction and longitudinal direction of the shadow mask, preventing the adverse effect on formability caused by what is known as statistical scatter of these characteristics. As shown in FIG. 5, the round electron beam holes 22 that were formed in the shadow mask 18 by the etching are all regularly arranged, and irregular holes 23 as shown in FIG. 7 for purposes of comparison were not produced. Furthermore, as shown in FIG. 6, the inclined faces 24 of the holes 22 were smoothly etched, and the rough holes (holes having a rough surface) 25 as shown for comparison in FIG. 8 were not produced.

Next, the shadow mask was washed in trichloroethylene vapour, and heated for 20 minutes in a continuous blackening furnace maintained at 700° C. to complete the shadow mask 18 by growing a tightly adhering 1.5 micron thick blackening film.

The frame 19, made by a similar technique, was then attached to the shadow mask by welding, and mounted on the panel 11 by means of a bimetallic spring support 20. The colour cathode ray tube was then completed by applying red, blue and green phosphors in correspondence with the holes of the shadow mask, Al evaporation, and Dag application, followed by attachment of the inner shield 16, and connection of this panel 11 to the funnel 12 at the rear of the envelope, on which is mounted the electron gun 17, and evacuation of the interior. The same material as that described above is also used for the aforementioned inner shield.

[Embodiment 2]

Respective ingots were prepared of alloys containing 32% Ni, 5% Co and Fe as the main constituent, and 3 wt % Cr, and, as incidental constituents, 0.05 wt % of C, 0.02 wt % of Si, and 0.001 wt % of P and S respectively. Shadow masks were then make using the ingots of the alloy, in the same way as in Embodiment 1, and these were used to manufacture colour cathode ray tubes.

In this embodiment too, it was found that spring-back did not occur and the material had excellent formability.

Figure 8:
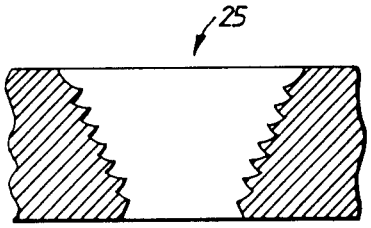
FIG. 8 is a cross-sectional view, to a larger scale, of part of a shadow mask with rough hole surfaces, for comparison with FIG. 6.

The relationship between the metallic structure of this material before etching, and the grain size, with the etching characteristics was then examined. It was found that irregularities were produced in etching when the structures other than austenite were reduced by the final annealing to a level such as to give an austenite percentage of as low as 70%. In the controlled rolling step, it was also found that if the grain size as defined in JIS-G0551 was adjusted to 7 (average 1,000 grains/mm$^2$), shadow mask portions 23*a* as shown in FIG. 7 were produced, where the apertures were not properly formed so as to penetrate through the shadow mask. On the other hand, if the said grain size was adjusted to a value of 12 (average 40,000 grains/mm$^2$) or more, as shown in FIG. 8, the inside wall of the etched holes became that of a "rough hole", unsuitable for a high-precision shadow mask.

In a shadow mask using the 8 wt % Cr ingot in the same way as in Embodiment 1, it was found that the same effects as this embodiment were occured.

[Embodiment 3]

First of all, an ingot of alloy containing 36% Ni, and Fe as the main constituent, with 6 wt % Cr, and 0.005 wt % C, 0.01 wt % Si, and 0.001 wt % Of each of P and S respectively was prepared by vacuum melting. This ingot was then subjected to repeated hot rolling, washed with acid, and the primary and secondary cold rolling steps performed. A draft of 80% was used in this process.

After the above rolling treatment, this material was annealed at $10^{-4}$ torr, 800° C. in a box-type annealing furnace, then subjected to controlled rolling with a draft of 10%. By this controlled rolling, an in-tube component material having an austenitic structure and of grain size 10 (8,200 grains/mm$^2$ on average) as defined in JIS-G0551 was obtained. A shadow mask was produced using the in-tube component material manufactured as above, by the method of Example 1. It was found that this shadow mask material had a small 0.2% yield point and excellent formability, and did not give rise to spring-back. It was also confirmed that the material characteristics were uniform in the width direction and longitudinal direction of the shadow mask, preventing the adverse effect on formability caused by what is known as statistical scatter of these characteristics.

[Embodiment 4]

An ingot of alloy containing 42% Ni, and Fe as the main constituent, with 3 wt % Cr, and 0.05 wt % C, 0.02 wt % Si, and 0.001 wt % of each of P and S respectively was prepared. A shadow mask was then produced using the ingots of this alloy by the method of Example 1. It was found that the shadow mask material of this embodiment had excellent formability, and did not give rise to spring-back.

An ingot of aforementioned alloy substituted with 8 wt % Cr also could produce the shadow mask as well as this embodiment.

[Embodiment 5]

The following Table shows the etching characteristics and formability of in-tube component material (samples (1) and (2)) according to this invention adjusted to grain size 2,000–40,000 grains/mm$^2$. This material was a 36Ni-4Cr-Fe alloy produced by including a 4% Cr content in an iron alloy of 36% Ni content. Sample (3) is given for purposes of comparison. This sample was a 36Ni-4Cr-Fe alloy whose grain size was not adjusted. Sample (4) is also given for purposes of comparison and is a sample with had a fine grain size produced by rolling. In both cases, the etching characteristics were poor. Also in the case of sample (4), it was found that some mask strain was produced, causing camber.

| No. | Grain size | Metallic structure | Etching characteristics | Formability |
|---|---|---|---|---|
| (1) | 10 mean 8,200 grains/mm$^2$ | 100% | good | good |
| (2) | 11 mean 16,400 grains/mm$^2$ | 95% | good | good |
| (3) | 7 mean 1,000 grains/mm$^2$ | 77% | poor | good |
| (4) | 12 mean 40,000 grains/mm$^2$ | 95% | rather poor | good |

In the above Table, the heading "Metallic structure" indicates the proportion of austenitic structure as determined by X-ray diffraction. The evaluation of "Etching characteristics" was made on the following basis: good etching characteristics—holes formed through the mask in over 99% of cases, the holes not having rough walls; rather poor etching characteristics—although holes were formed through the mask in over 99% of cases, the holes were "rough holes". The criterion of good formability was that spring-back was less than 20 micron on forming after annealing the etched flat plate at 1100° C. in vacuum.

As shown by this Table, the effectiveness of this invention is considerable in that with in-tube component material according to this invention both good etching characteristics and good formability can be obtained. The same effect is obtained by adding Cr to an alloy consisting of 25–35 wt % Ni, and 0.2–10 wt %, preferable 3–6 wt %, of Co, and the remainder Fe. However, it should be noted that a material whose thermal coefficient of expansion has been further reduced by Co addition has a 0.2% yield point about 2–5 kg/mm$^2$ higher than when no Co is added, and so has poorer formability. A material according to this invention is therefore very useful in that the Cr addition gives a lower 0.2% yield point without increasing the thermal expansion coefficient.

In the above description, the forming of a shadow mask has been taken as the example. However, other components of a colour cathode ray tube, such as the inner shield, frame, or bimetallic element, can also be manufactured using the intube component material of this invention. This invention can also be put into practice in various ways without departing from its essence.

What is claimed is:

1. An in-tube component material which consists of: an alloy of at least 25–45 wt % 0.3–10 wt % Cr, 0.10 wt % Co, and the balance Fe and unavoidable impurities, said alloy having a grain size ranging from 2,000–40,000 grains/mm$^2$.

2. The in-tube component material of claim 1, wherein said alloy contains at least 0.2 wt. % Co.

3. The in-tube component material of claim 1, wherein said alloy contains 1–4 wt. % Cr.

4. The in-tube component material of claim 1, wherein said alloy has an at least 80% austenitic structure.

5. The in-tube component of claim 1, wherein the thermal expansion coefficient of said alloy is less than $90\times10^{-7}$/°C.

6. A method of manufacturing an in-tube component material, comprising:

(a) melting a composition consisting of from 25 to 45 wt. % Ni, from 0.2–10 wt. % Cr, from 0–10 wt. % Co with the remainder being Fe and unavoidable impurities;

(b) solidifying the molten alloy which results;

(c) rolling and then annealing said solidified alloy;

(d) final cold rolling said annealed alloy under the conditions of a draft of at least 40%;

(e) annealing said cold rolled alloy at a temperature within the range of 500°–1200° C.; and (f) rolling said annealed alloy under conditions of a draft of 30% or less, the resulting alloy having a grain size ranging from 2,000 to 40,000 grains/mm$^2$.

7. The method of claim 6, wherein the final cold rolling of step (d) is conducted at a draft of at least 70%.

8. The method of claim 6, wherein the controlled rolling in step (f) is completed by strain-relief annealing conducted at a temperature below 800° C. after the rolling treatment.

9. The method of claim 6, wherein the alloy product prepared by the process has an austenitic structure of at least 80%.

10. The in-tube component material of claim 1, wherein said in-tube component material is in the form of a shadow-mask for a color cathode ray tube.

11. The method of claim 6, wherein said in-tube component material is in the form of a shadow-mask for a color cathode ray tube.

12. The method of claim 6, wherein the annealing temperature of step (e) ranges from 900° to 1100° C.

* * * * *